US010940354B2

(12) United States Patent
Oltorik Jr.

(10) Patent No.: US 10,940,354 B2
(45) Date of Patent: Mar. 9, 2021

(54) PORTABLE RESISTANCE WORKOUT APPARATUSES AND SYSTEMS

(71) Applicant: Dennis Ross Oltorik Jr., Cincinnati, OH (US)

(72) Inventor: Dennis Ross Oltorik Jr., Cincinnati, OH (US)

( * ) Notice: Subject to any disclaimer, the term of this patent is extended or adjusted under 35 U.S.C. 154(b) by 0 days.

(21) Appl. No.: 15/962,413

(22) Filed: Apr. 25, 2018

(65) Prior Publication Data

US 2018/0236295 A1 Aug. 23, 2018

Related U.S. Application Data

(63) Continuation of application No. 14/868,255, filed on Sep. 28, 2015, now Pat. No. 10,220,236.
(Continued)

(51) Int. Cl.
*A63B 21/04* (2006.01)
*A63B 21/055* (2006.01)
(Continued)

(52) U.S. Cl.
CPC ..... *A63B 21/0442* (2013.01); *A63B 21/0555* (2013.01); *A63B 21/0557* (2013.01);
(Continued)

(58) Field of Classification Search
CPC ..... A63B 21/00058; A63B 21/00061; A63B 21/00065; A63B 21/00069; A63B 21/00072; A63B 21/00076; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/06;
(Continued)

(56) References Cited

U.S. PATENT DOCUMENTS 1,623,670 A * 4/1927 Frankenfeld ..... A63B 21/04 482/123
1,623,671 A * 4/1927 Frankenfeld ..... A63B 21/0552 482/123

(Continued)

*Primary Examiner* — Gary D Urbiel Goldner
(74) *Attorney, Agent, or Firm* — Ulmer & Berne LLP

(57) ABSTRACT

The invention comprises a portable strength-training apparatus and system for conducting strength-training exercises using resistance bands. The apparatus of the present disclosure can serve as an anchor while conducting the strength training exercises using the resistance bands. The apparatus and system of the present disclosure can allow for safely performing the strength-training exercises at varying resistance levels while allowing exercises at any angle. The apparatus and system of the present disclosure may allow a user to strength train with the resistance bands throughout the user's entire body. The apparatus and system of the present disclosure may include a base platform with base attachment mechanisms that can be coupled with the resistance bands which are in turn coupled with human interface mechanisms such as grips, wraps, or bars.

15 Claims, 6 Drawing Sheets

Related U.S. Application Data

(60) Provisional application No. 62/055,751, filed on Sep. 26, 2014.

(51) Int. Cl.
*A63B 21/00* (2006.01)
*A63B 21/16* (2006.01)
*A63B 23/035* (2006.01)
*A63B 71/02* (2006.01)

(52) U.S. Cl.
CPC ..... *A63B 21/16* (2013.01); *A63B 21/4034* (2015.10); *A63B 21/4037* (2015.10); *A63B 21/4043* (2015.10); *A63B 23/03525* (2013.01); *A63B 23/03541* (2013.01); *A63B 21/4009* (2015.10); *A63B 21/4021* (2015.10); *A63B 2071/027* (2013.01); *A63B 2210/50* (2013.01)

(58) Field of Classification Search
CPC ... A63B 21/065; A63B 21/068; A63B 21/072; A63B 21/0722; A63B 21/0724; A63B 21/0726; A63B 21/08; A63B 21/15; A63B 21/151; A63B 21/159; A63B 21/16; A63B 21/1609; A63B 21/1618; A63B 21/1627; A63B 21/1636; A63B 21/1645; A63B 21/1654; A63B 21/1663; A63B 21/1672; A63B 21/1681; A63B 21/169; A63B 21/4001; A63B 21/4009; A63B 21/4011; A63B 21/4013; A63B 21/4015; A63B 21/4017; A63B 21/4019; A63B 21/4021; A63B 21/4023; A63B 21/4025; A63B 21/4027; A63B 21/4033; A63B 21/4034; A63B 21/4035; A63B 21/4037; A63B 21/4039; A63B 21/4041; A63B 21/4043; A63B 23/00; A63B 23/02; A63B 23/0205; A63B 23/0211; A63B 23/0216; A63B 23/0222; A63B 23/0227; A63B 23/035; A63B 23/03508; A63B 23/03516; A63B 23/03525; A63B 23/03533; A63B 23/03541; A63B 23/0355; A63B 23/03558; A63B 23/03566; A63B 23/03575; A63B 23/04; A63B 23/0405; A63B 23/0482; A63B 23/0488; A63B 23/0494; A63B 23/08; A63B 23/12; A63B 23/1209; A63B 23/1245; A63B 23/1281; A63B 23/14; A63B 2023/003; A63B 2023/006; A63B 2023/0411; A63B 26/00; A63B 26/003; A63B 69/0057; A63B 69/0059; A63B 2069/0062; A63B 71/0054; A63B 71/02; A63B 71/023; A63B 2071/0063; A63B 2071/0072; A63B 2071/026; A63B 2071/027; A63B 2208/02; A63B 2208/0204; A63B 2208/0209; A63B 2208/0214; A63B 2208/0219; A63B 2208/0223; A63B 2208/0228; A63B 2208/0238; A63B 2208/0242; A63B 2208/0247; A63B 2208/0252; A63B 2208/0257; A63B 2208/0266; A63B 2208/0295; A63B 2210/00; A63B 2210/50; A63B 2225/09; A63B 2225/093; A63B 2225/10; A63B 2225/102; A63B 2225/105; A63B 2225/107
See application file for complete search history.

(56) References Cited

U.S. PATENT DOCUMENTS 2,829,891 A * 4/1958 Ludwig ..... A63G 11/00 482/146
3,633,907 A * 1/1972 Cane ..... A63B 21/055 482/123
4,198,044 A * 4/1980 Holappa ..... A63B 21/04 482/130
4,371,162 A * 2/1983 Hartzell ..... A63B 21/04 482/123
4,863,163 A * 9/1989 Wehrell ..... A63B 5/16 482/123
4,968,028 A * 11/1990 Wehrell ..... A63B 5/16 482/124
4,982,958 A * 1/1991 Ullman ..... A63B 21/04 482/123
5,292,297 A * 3/1994 Hsu ..... A63B 22/14 482/145
5,551,934 A * 9/1996 Binette ..... A63B 23/0482 482/123
5,645,510 A * 7/1997 Wilkinson ..... A63B 5/11 482/27
6,299,569 B1 * 10/2001 Rich ..... A63B 21/0004 482/121
6,500,104 B1 * 12/2002 Rich ..... A63B 21/04 482/123
6,558,301 B1 * 5/2003 Jackson ..... A63B 21/0552 482/121
6,872,175 B2 * 3/2005 Lin ..... A63B 21/0004 482/121
7,431,681 B1 * 10/2008 St. Cyr ..... A63B 21/0552 482/121
D590,457 S * 4/2009 Mishan ..... D21/686
7,608,025 B1 * 10/2009 Best ..... A63B 21/0023 482/123
7,648,449 B1 * 1/2010 Detert ..... A47C 27/081 441/129
7,739,775 B2 * 6/2010 Shimanski ..... B60P 7/0807 24/265 H
7,951,054 B2 * 5/2011 Snow ..... A63B 21/0552 482/136
7,967,736 B2 * 6/2011 D'Silva ..... A63B 22/0087 482/121
8,088,050 B2 * 1/2012 Aucamp ..... A63B 21/0552 482/126
D700,792 S * 3/2014 Melton ..... D6/675
8,684,894 B2 * 4/2014 Flynn ..... A63B 21/0004 482/121
8,721,507 B2 * 5/2014 Blancher ..... A63B 21/4033 482/121
8,936,539 B2 * 1/2015 Richard ..... A63B 71/0036 482/123
9,061,172 B1 * 6/2015 Carrier ..... A63B 23/0458
9,199,110 B2 * 12/2015 Jones ..... A63B 5/16
9,259,606 B2 * 2/2016 Wolan ..... A63B 21/0442
RE46,874 E * 5/2018 D'Silva
10,220,236 B2 * 3/2019 Oltorik, Jr. ..... A63B 21/0442
2003/0083178 A1 * 5/2003 Gilman ..... A63B 21/0552 482/92
2006/0019806 A1 * 1/2006 Mikulski ..... A63B 21/0552 482/121
2006/0199706 A1 * 9/2006 Wehrell ..... A63B 21/4019 482/92
2007/0087920 A1 * 4/2007 Dachraoui ..... A63B 21/0552 482/123
2009/0305854 A1 * 12/2009 Brown, Jr. ..... A63B 21/04 482/140
2010/0016132 A1 * 1/2010 Flynn ..... A63B 21/4015 482/122
2010/0323857 A1 * 12/2010 D'Silva ..... A63B 21/154 482/121
2011/0021329 A1 * 1/2011 Dunne ..... A63B 21/169 482/124

(56) References Cited

U.S. PATENT DOCUMENTS

| | | | | |
|---|---|---|---|---|
| 2011/0218077 | A1* | 9/2011 | Fernandez | A63B 26/00 482/8 |
| 2011/0251033 | A1* | 10/2011 | Blancher | A63B 22/16 482/123 |
| 2012/0115692 | A1* | 5/2012 | Bussen | A63B 21/0442 482/130 |
| 2012/0244997 | A1* | 9/2012 | Thompson | A63B 21/00047 482/27 |
| 2013/0244835 | A1* | 9/2013 | Thompson | A63B 21/28 482/8 |
| 2014/0066262 | A1* | 3/2014 | Kennedy | A63B 21/0442 482/52 |
| 2014/0113773 | A1* | 4/2014 | Marghella | A63B 22/20 482/38 |
| 2014/0155232 | A1* | 6/2014 | Wolan | A63B 21/4033 482/123 |
| 2014/0162858 | A1* | 6/2014 | Dalebout | A63B 26/003 482/142 |
| 2014/0287894 | A1* | 9/2014 | Austin | A63B 21/0442 482/142 |
| 2015/0018178 | A1* | 1/2015 | Carbone | A63B 71/0009 482/146 |
| 2015/0024914 | A1* | 1/2015 | Lagree | A63B 22/0089 482/142 |
| 2016/0144217 | A1* | 5/2016 | Oltorik, Jr. | A63B 23/03525 482/130 |
| 2020/0023229 | A1* | 1/2020 | Oltorik | A63B 21/4033 |

* cited by examiner

PORTABLE RESISTANCE WORKOUT APPARATUSES AND SYSTEMS

RELATED APPLICATIONS

The present application is a continuation of U.S. patent application Ser. No. 14/868,255, filed Sep. 28, 2015, which is hereby incorporated herein by reference in its entirety. The present application claims priority under 35 U.S.C. § 119 based on U.S. Provisional Application No. 62/055,751, filed on Sep. 26, 2014, which are hereby incorporated herein by reference in their entirety.

FIELD OF INVENTION

The present disclosure contemplates an apparatus, system and method for conducting strength training exercises using resistance bands. The present disclosure further contemplates an apparatus, system, and method for conducting strength training exercises where resistance bands may be attached to a portable platform base.

BACKGROUND

Previous apparatuses and systems used for resistance workouts are complicated and unwieldy. Previous apparatuses and systems are also susceptible to limiting constraints, such as the portability of the device, the limited use of a single participant, and the lack of personalization to individual skill level. Still further, previous anchoring apparatuses and systems lack versatility in their integration into an exercise program. For example, some platforms are designed to only incorporate a user's body weight, thereby eliminating its potential use for a heavy lifter, while other platforms have bulky parts or bands that can only be incorporate in a limited number of directions and amount in resistance, thereby eliminating its use for effectiveness.

SUMMARY OF INVENTION

The present disclosure contemplates portable strength-training apparatus and system for conducting strength-training exercises using resistance bands. The apparatus of the present disclosure can serve as an anchor while conducting strength training exercises using resistance bands. The apparatus and system of the present disclosure can allow for safe strength-training exercises at varying resistance levels while allowing exercises at any angle. Resistance band strength-training may reduce the risk of injury compared to traditional weight-based strength-training. The apparatus and system of the present disclosure may allow a user to strength train with resistance bands throughout entire body. The apparatus and system of the present disclosure can be used in home workouts, at the gym, with personal trainers, for professional athletes, for physical therapy, or in the outdoors.

The apparatus and system of the present disclosure may allow for more rapid alteration of the level of resistance than prior resistance workout apparatuses or systems. The apparatus and system of the present disclosure may allow resistance to be quickly altered by manipulating the length of a resistance band that is already in use or by adding or removing resistance bands. The apparatus and system of the present disclosure allow the user to use multiple resistance bands during a workout. The platform base of the present disclosure is designed to allow multiple bands to be securely attached to the platform base. The variability of the apparatus and system of the present disclosure manipulating the length of the resistance bands or using multiple bands may allow the user to experience a wide range of resistance from just a few pounds of resistance up to hundreds of pounds of resistance.

In one embodiment the portable strength training apparatus can have a platform base with one or more base attachment mechanisms for attaching resistance bands. The platform base can be portable to allow workouts to be conducted at many locations, such as inside a home, outside in a park, in the office, or at the gym. The platform base can be lightweight so that it can be moved by one person. Base attachment mechanisms on the platform base can allow one or more resistance bands to be attached to the platform base. The one or more resistance band(s) can attach to the base attachment mechanisms on the platform base using a hook or clip or other common coupling mechanism. The resistance bands can also wrap around the base attachment mechanisms or weave through the base attachment mechanisms to shorten the effective length of the resistance band allowing the user to quickly alter the difficulty of the strength training exercise. The base attachment mechanisms on the platform base can extend upward from the top surface of the platform base and be located at various positions throughout the top surface of the platform base or the base attachment mechanisms can be situate in base voids that pass through the platform base. When the base attachment mechanisms extend upward from the top surface of the base platform, one or more securing mechanism can be used to secure resistance bands that are wrapped around or weaved through the base attachment mechanism. The securing mechanism can be elastic bands that squeeze the resistance band and part of the base attachment mechanism together thus ensuring that the resistance band does not unwind or unweave from the base platform during use.

A person using the platform base can stand on the top surface of the platform base when conducting strength-training exercises or the person can stand off of the platform base if the platform base is fixed to an immobile structural component or secured with weights. Standing on the platform base can allow the user to incorporate resistance bands in multiple strength exercises. The portable strength-training apparatus can have a hinge in the platform base that allows the platform base to fold over on to itself for easier portability. The portable strength-training apparatus can have a handle such as a handle which may allow the user to more easily transport the portable strength-training apparatus.

The present disclosure further contemplates a portable strength training system that includes a platform base, resistance bands, base attachment mechanisms, human attachment mechanisms, and coupling mechanisms. The resistance bands may have the coupling mechanisms attached to either end with one end coupling with the base attachment mechanisms and one end coupling to the human attachment mechanism. The human attachment mechanism can be hand grips, wrist straps, ankle straps, a waist strap, or a workout bar. The human attachment mechanisms can allow one or more resistance bands to be attached. The workout bar can also be broken down in to two or more components for transporting with the base platform. Again, the portable strength training system of the present disclosure may allow for safe strength training exercises at varying resistance levels while allowing exercises at any angle. The system of the present disclosure may allow the user to incorporate nearly unlimited levels of resistance to multiple strength-training exercises.

The present disclosure further contemplates a method for strength training that includes the steps of coupling one or more resistance bands to a portable platform base, where the platform base has a top surface, a bottom surface, and a plurality of base attachment mechanisms. In the contemplated method the one or more resistance bands are coupled to the platform base at the base attachment mechanisms via a coupling mechanism. The method of strength training further includes standing on top of the platform base and stretching the one or more resistance bands by applying pressure to one or more of a human interface mechanism. The one or more of the human interface mechanisms may be coupled to the one or more resistance bands which are in turn coupled to the platform base at the base attachment mechanisms.

BRIEF DESCRIPTION OF THE DRAWINGS

The foregoing and other features of the present disclosure will become more fully apparent from the following description, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1:
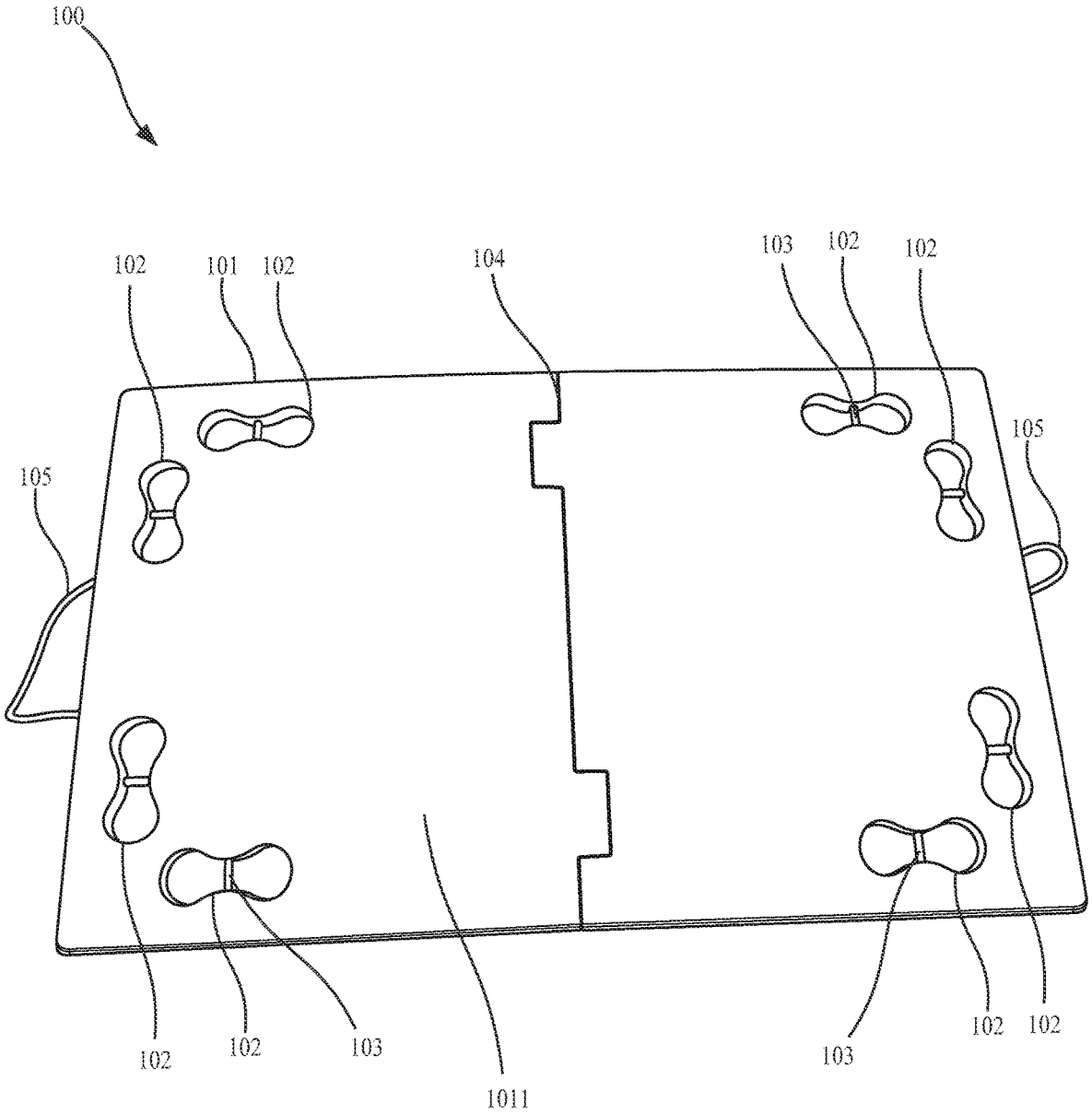
FIG. 1 is a top view of an example portable strength training apparatus with base attachment mechanisms situated in base voids.

In the following detailed description, reference is made to the accompanying drawings, which form a part hereof. In the drawings, similar symbols typically identify similar components, unless context dictates otherwise. The illustrative embodiments described herein are not meant to be limiting. Other embodiments may be utilized, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

Figure 2:
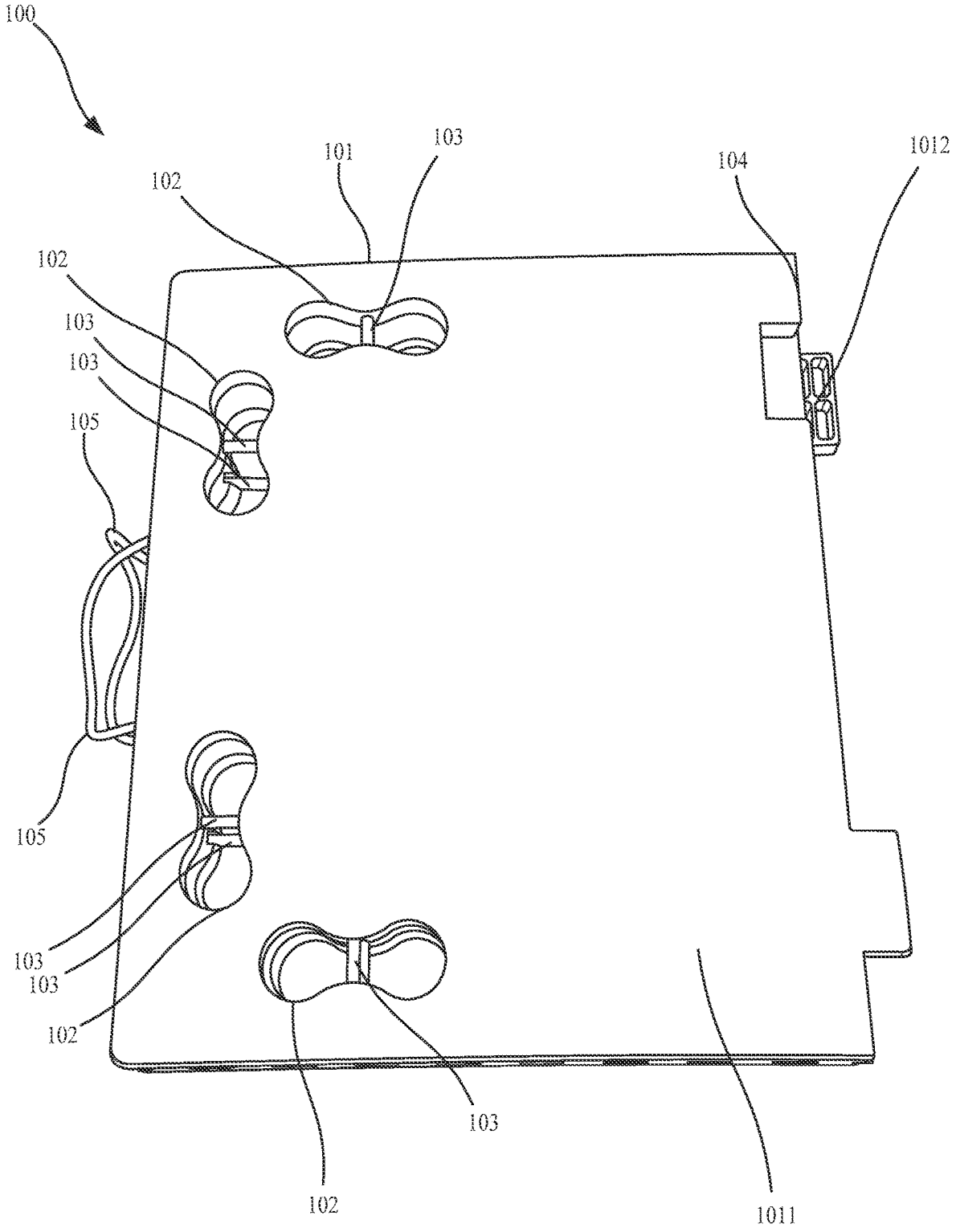
FIG. 2 is a top view of an example portable strength training apparatus with base attachment mechanisms situated in base voids where the platform base is folded along the hinge.

FIG. 1 and FIG. 2 depict an example portable strength training apparatus 100 having a platform base 101 having a top surface 1011, a bottom surface 1012, and a plurality of base attachment mechanisms 103, wherein one or more of the plurality of base attachment mechanisms 103 may be removably coupled with a resistance band. In FIG. 1 the base attachment mechanisms 103 are situated within base voids 103 that pass through the platform base 101. The base attachment mechanisms 103 may be metal, plastic, or another material capable of withstanding the pressure of the resistance bands. The base voids 102 may be placed anywhere throughout the platform base 101 and there may be any number of base voids 102 and corresponding base attachment mechanism 103. The base voids 102 should be large enough to allow coupling between the resistance band and the base attachment mechanism 103. The platform base 101 may be made of plastic, metal, or another material that will not bow or shift when pressure is applied through the resistance bands. The platform base 101 and included base voids 102 and base attachment mechanisms 103 may be formed using common injection molding, stamping, vacuum molding, or welding processes. The platform base 101 may have a lower weight to allow a single person to transport the portable strength training apparatus 100.

Resistance bands 106 (not shown) may be wrapped around one or more of the plurality of base attachment mechanisms 103 before or after the resistance band 106 is coupled to one of the plurality of base attachment mechanism 103. The wrapping and weaving of the resistance band 106 shortens the effective length of the resistance band 106, thus increasing the pressure that must be applied to stretch the resistance band 106. The base voids 102 may allow the resistance bands 106 to wrap around and weave through base attachment mechanisms 103.

The portable strength training apparatus 100 may have a hinge 104. The hinge 104, as depicted in FIG. 2, may allow the platform base 101 to fold over on to itself for easier transportation. The portable strength training apparatus 100 may have a handle 105, such as hand holds, again for easier transportation. The handle 105 may be rope, plastic, metal, or other material capable of sustaining the weight of the portable strength training apparatus 100 during transportation. The handle 105 may be attached to the platform base during molding process, through welding, using an adhesive, or using another method capable of sustaining the weight of the portable strength training apparatus 100 during transportation.

Figure 3:
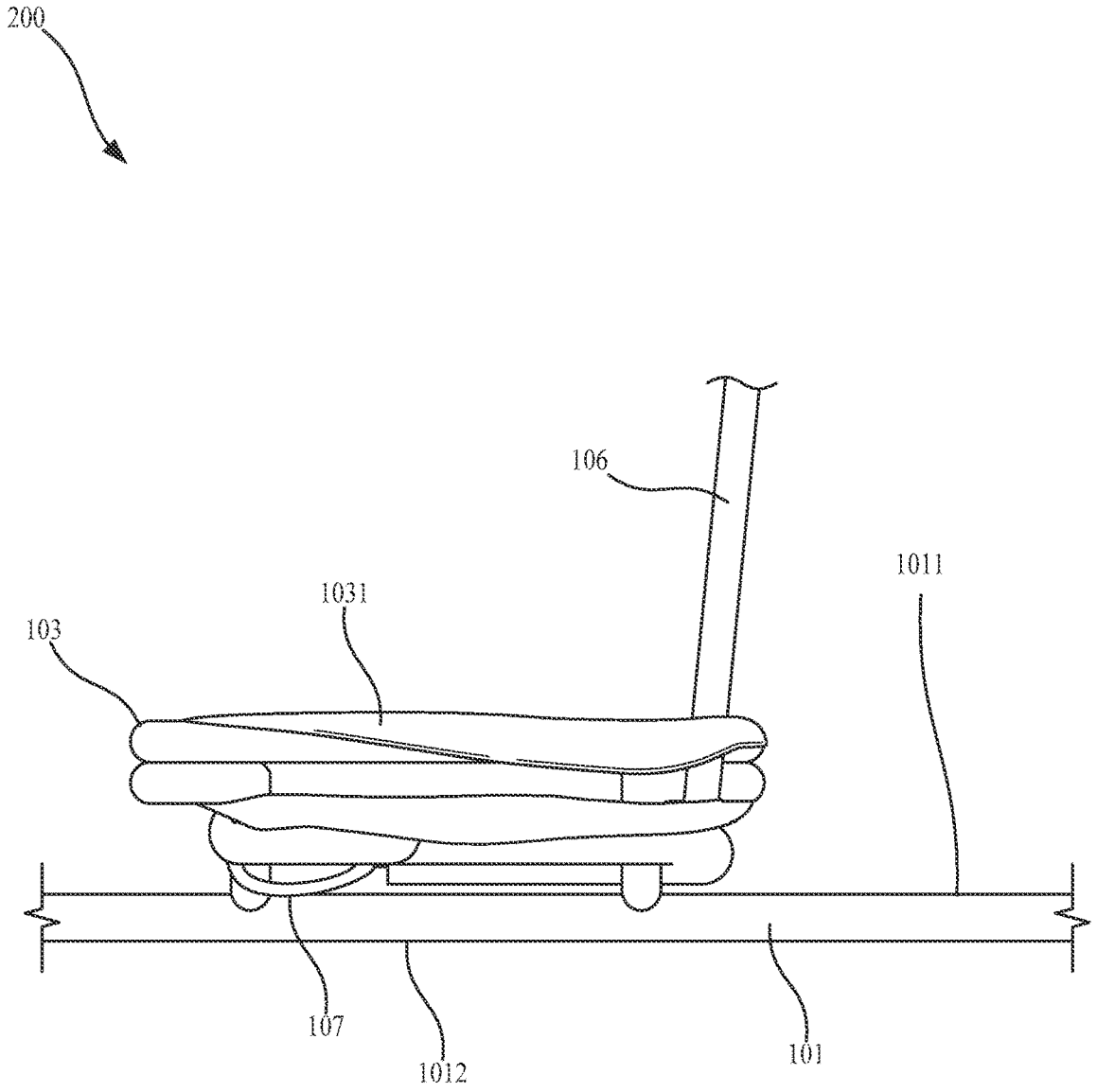
FIG. 3 is a side view of a portion of an example portable strength training system with base attachment mechanisms extending upward from the top surface of the platform base.

FIG. 3 depicts a portion of an example portable strength training system 200 with the plurality of base attachment mechanisms 103 extending upward from the top surface 1011 of the platform base 101 when the bottom surface 1012 of the platform base 101 is in contact with the ground. The coupling mechanism 107 allows a resistance band 106 to be removably coupled to one or more of the plurality of base attachment mechanisms 103. The resistance band 106 may be wrapped around one or more of the plurality of base attachment mechanisms 103 before or after the resistance band 106 is coupled to one of the plurality of base attachment mechanism 103. One or more securing mechanisms 1031 can be used to secure resistance bands 106 that are wrapped around or weaved through the base attachment mechanism 103. The securing mechanism 1031 can be elastic band that squeezes the resistance band 106 and part of the base attachment mechanism 103 together to further lock the resistance band 106 during use so the resistance band 106 does not unwind or unweave from the base platform 101 during use.

Figure 4:
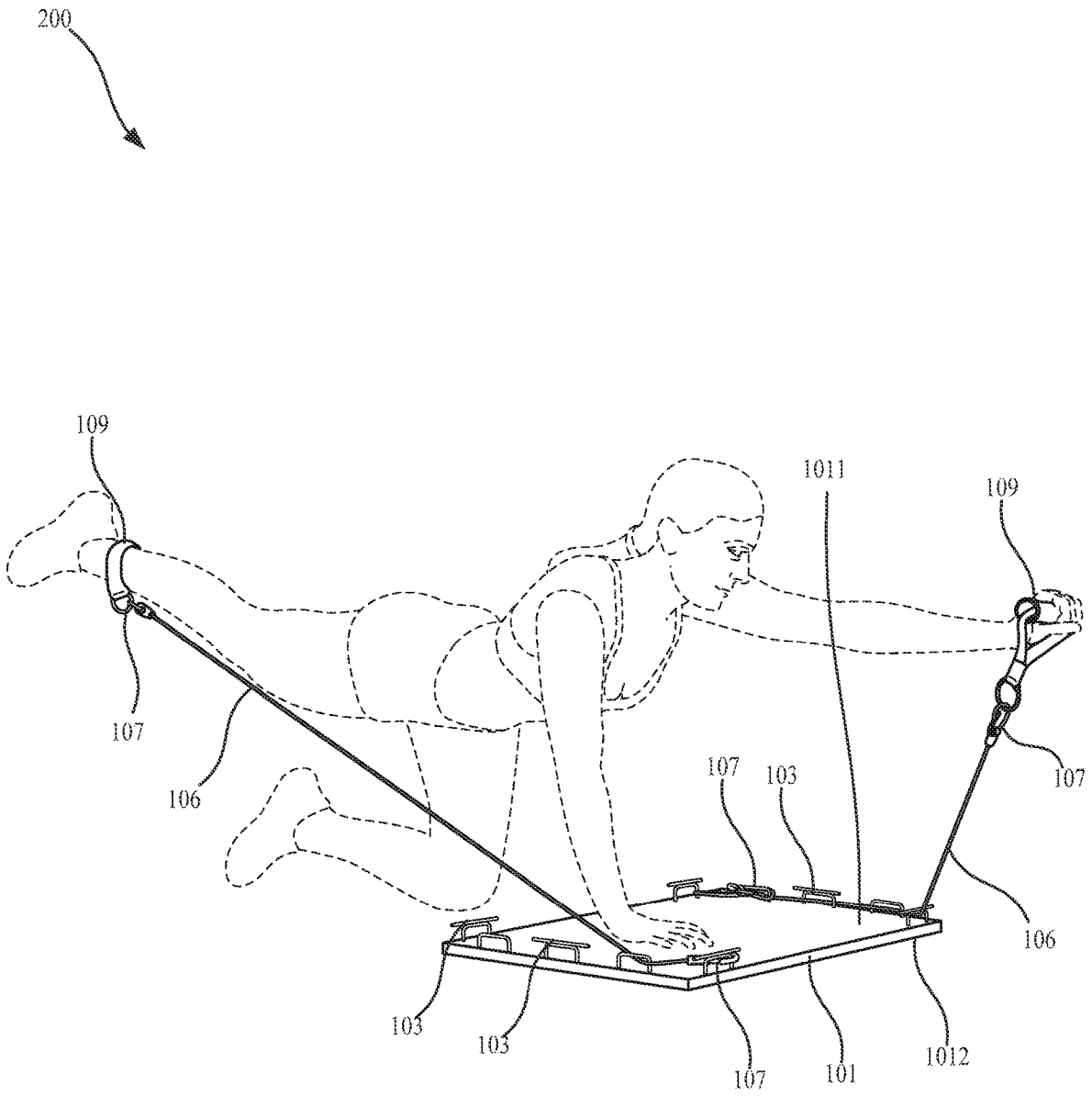
FIG. 4 is a perspective view of an example portable strength training system with base attachment mechanisms extending upward from the top surface of the platform base.
Figure 5:
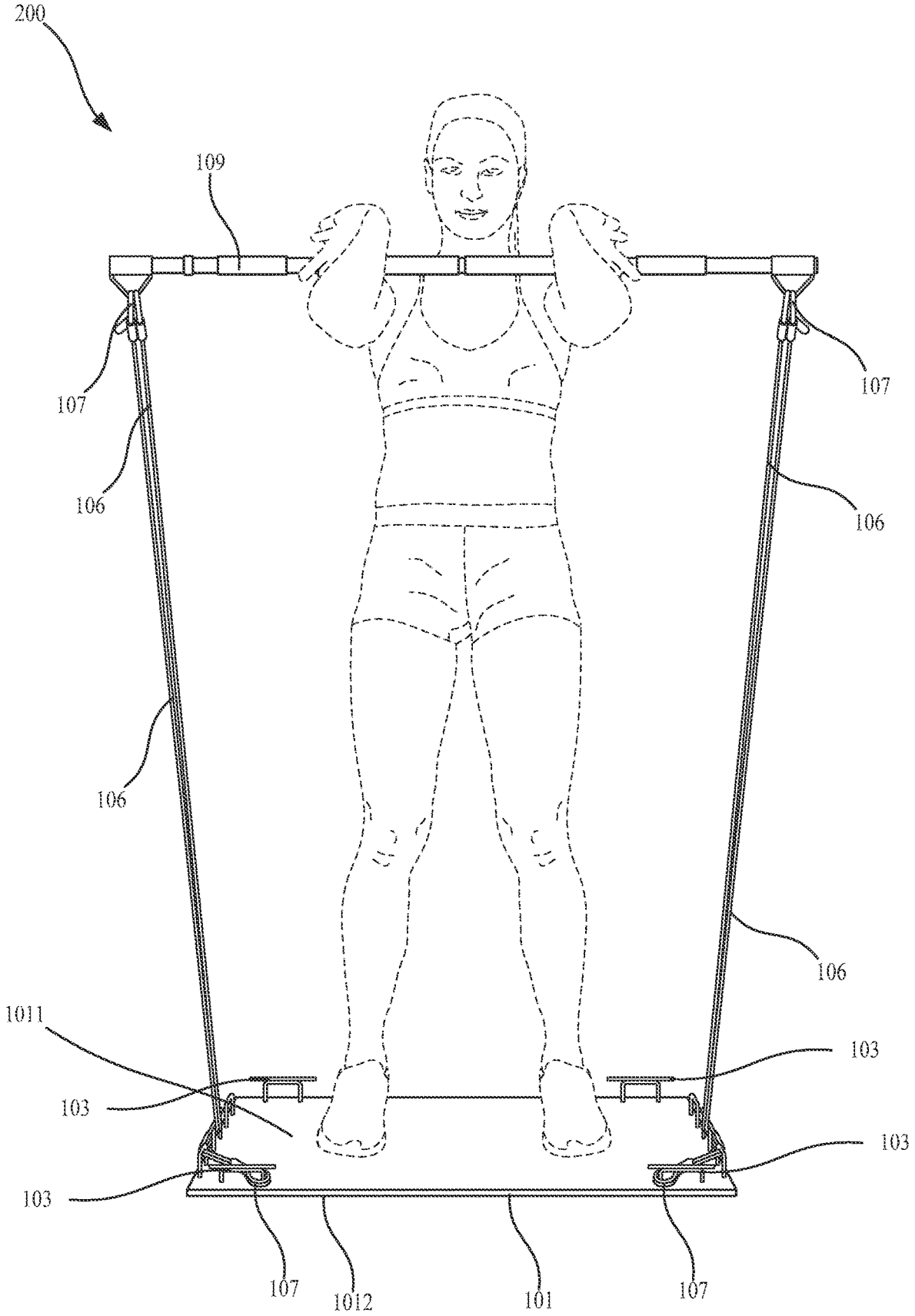
FIG. 5 is a perspective view of an example portable strength training system with base attachment mechanisms extending upward from the top surface of the platform base.

FIG. 4 and FIG. 5 depict example portable strength training systems 200 with the plurality of base attachment mechanisms 103 extending upward from the top surface 1011 of the platform base 101 when the bottom surface 1012 of the platform base 101 is in contact with the ground. Again the coupling mechanism 107 allows a resistance band 106 to be removably coupled to one or more of the plurality of base attachment mechanisms 103. Again, resistance bands 106 may be wrapped around one or more of the plurality of base attachment mechanisms 103 before or after the resistance band 106 is coupled to one of the plurality of base attachment mechanism 103. The wrapping and weaving of the resistance band 106 shortens the effective length of the resistance band 106, thus increasing the pressure that must be applied to stretch the resistance band 106.

The portable strength training systems 200 includes one or more human interface mechanisms 109. The human interface mechanism 109 allow the one or more resistance bands 106 to be stretched by applying pressure to the one or more human interface mechanisms 109. The human interface mechanism can be a hand grip or an ankle strap as shown in FIG. 4 or a workout bar as shown in FIG. 5, or another strap or grip, such as a wrist strap, a waist strap, or foot grip. Any combination of human interface mechanisms 109 can be applied to vary the maneuver and the angle of the maneuver used to stretch the resistance bands 106 in order to strengthen difference muscles and muscle groups. Coupling the resistance bands 106 to base attachment mechanisms 103 at different locations on the base platform 101 can also vary the maneuver and the angle of the maneuver used to stretch the resistance bands 106 in order to strengthen difference muscles and muscle groups. When the human interface mechanism is a workout bar as shown in FIG. 5, it may be disassembled into two or more pieces for easier transport, thus further enhancing the portability of portable strength training systems 200 of the present disclosure. The human interface mechanisms 106 can have a rounded or V-shaped area that allows coupling with multiple resistance bands 106 via the coupling mechanisms 107. The coupling mechanisms 107 may be metal or plastic clips or hooks or another element capable of removably coupling the resistance band 106 to the base attachment mechanisms 103 and the human interface mechanisms 109.

The resistance bands 106 may be of varying length, diameter, and elastic material to allow for varying resistance. The resistance bands 106 may include a protective cover made of cloth or another enclosing material that protects the user of the portable strength training system 200 in case the resistance band 106 breaks during use. As shown in FIG. 5, multiple resistance bands 106 can be used between the same base attachment mechanisms 103 and human interface mechanism 109 to increase the pressure needed to stretch the resistance bands 106. The user of the portable strength training system 200 of the present disclosure can apply downward pressure to the base platform 101 with a hand as shown in FIG. 4 or by standing on the base platform 101 as shown in FIG. 5. The base platform 101 can also be rendered immobile by fixing it to secure structure, applying weights to the base platform 101, by the user applying pressure to the base platform 101 through a body part, or by a spotter applying pressure to the base platform 101 by standing on it or applying pressure through a body part.

Figure 6:
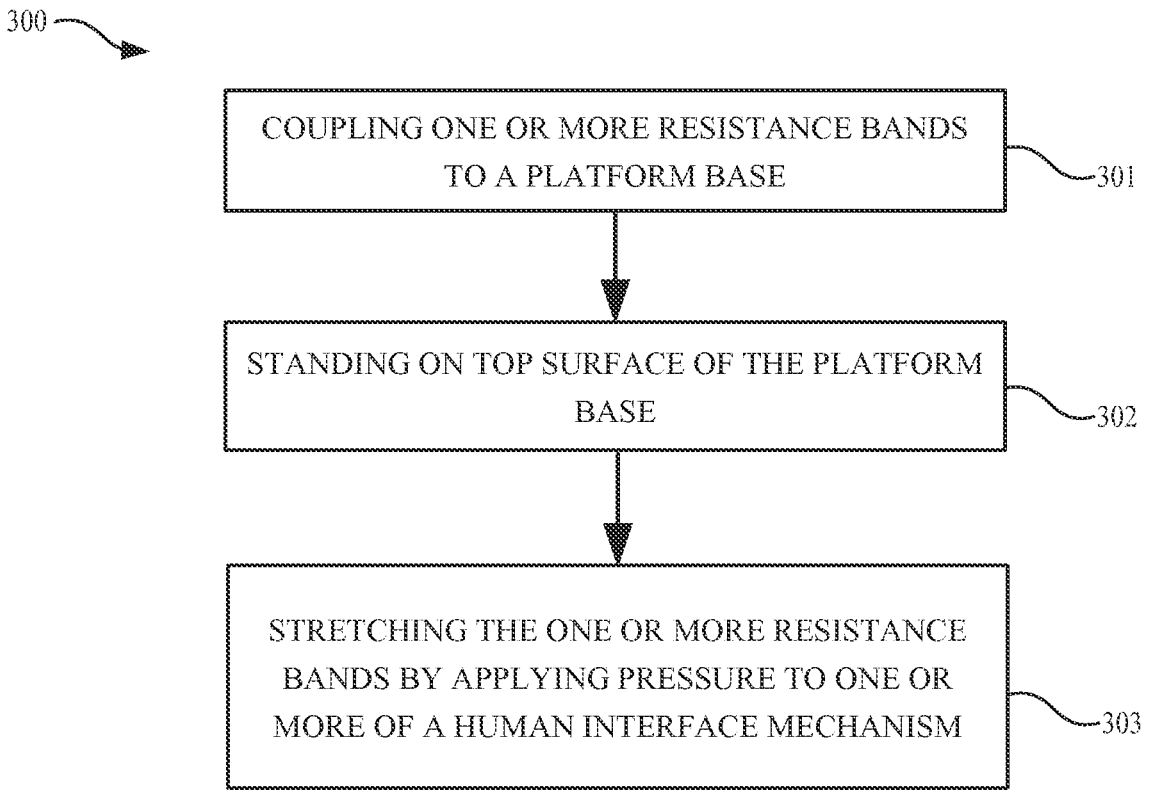
FIG. 6 is a flowchart of an example method for strength training.

FIG. 6 depicts an example of a method for strength training 300 that includes coupling one or more resistance bands to a platform base 301, standing on the top surface of the platform base 302, and stretching one or more resistance bands by applying pressure to one or more human interface mechanisms 303. The method for strength training 300 may use the portable strength training apparatus 100 and portable strength training system 200 described above.

While various aspects and embodiments have been disclosed herein, other aspects and embodiments will be apparent to those skilled in the art. The various aspects and embodiments disclosed herein are for purposes of illustration and are not intended to be limiting.

The sections above may set forth one or more but not all exemplary embodiments and thus are not intended to limit the scope of the present disclosure and the appended claims in any way. Embodiments have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptation and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

Following from the above description summaries, it should be apparent to those of ordinary skill in the art that, while the methods, apparatuses and data structures herein described constitute exemplary embodiments of the current disclosure, it is to be understood that the inventions contained herein are not limited to the above precise embodiments and that changes may be made without departing from the scope of the invention as claimed. Likewise it is to be understood that it is not necessary to meet any or all of the identified advantages or objects of the invention disclosed herein in order to fall within the scope of the inventions, since inherent and/or unforeseen advantages of the current disclosed embodiments may exist even though they may not have been explicitly discussed herein.

What is claimed is:

1. A portable strength training apparatus, comprising:

a. a platform base having a top surface, a bottom surface, and a hinge, wherein the platform base may be folded about the hinge;

b. a handle coupled to the platform base;

c. a plurality of base voids in the platform base, wherein the plurality of base voids extend through the top surface of the platform base and extend through the bottom surface of the platform base such that the plurality of base voids pass all the way through the platform base; and d. a plurality of base attachment mechanisms disposed between the top surface of the platform base and the bottom surface of the platform base respectively within the plurality of base voids, wherein one or more of the plurality of base attachment mechanisms is removably coupled to a resistance band having a first end and a second end, and wherein the resistance band may be wrapped around the one or more of the plurality of base attachment mechanisms before or after the resistance band is coupled to one of the plurality of base attachment mechanisms.

2. The portable strength training apparatus of claim 1, wherein the first end of the resistance band is coupled with one of the plurality of base attachment mechanisms and the second end of the resistance band is coupled with one of a plurality of human interface mechanisms, further wherein the resistance band can be stretched by applying pressure to the one of the plurality of human interface mechanisms.

3. The portable strength training apparatus of claim 2, wherein the one of the plurality of human interface mechanisms is selected from the group consisting of a hand grip, a wrist strap, an ankle strap, a waist strap, and a workout bar.

4. The portable strength training apparatus of claim 1, wherein the platform base is made of a material selected from the group consisting of plastic and metal.

5. The portable strength training apparatus of claim 1, wherein the handle is made of rope, plastic, or metal.

6. A portable strength training apparatus, comprising:

a. a platform base having a top surface, a bottom surface, and a hinge, wherein the platform base may be folded about the hinge;

b. a plurality of base voids in the platform base, wherein the plurality of base voids extend through the top surface of the platform base and extend through the bottom surface of the platform base such that the plurality of base voids pass all the way through the platform base;

c. a plurality of base attachment mechanisms disposed between the top surface of the platform base and the bottom surface of the platform base respectively within the plurality of base voids; and d. a plurality of resistance bands each having a first end and a second end, wherein the first end of each of the plurality of resistance bands is respectively coupled with one of the plurality of base attachment mechanisms and the second end of each of the plurality of resistance bands is coupled with a workout bar, the workout bar comprising at least two connectable bar pieces, wherein each of the plurality of resistance bands may be wrapped around one or more of the plurality of base attachment mechanisms before or after each of the plurality of resistance bands is coupled to the respective one of the plurality of base attachment mechanisms.

7. The portable strength training apparatus of claim 6, further comprising a handle coupled to the platform base.

8. The portable strength training apparatus of claim 7, wherein the handle is made of rope, plastic, or metal.

9. The portable strength training apparatus of claim 6, wherein the platform base is made of a material selected from the group consisting of plastic and metal.

10. A portable strength training system, comprising:

a. a platform base having a top surface and a bottom surface;

b. a handle coupled to the platform base;

c. a plurality of base voids in the platform base, wherein the plurality of base voids extend through the top surface of the platform base and extend through the bottom surface of the platform base such that the plurality of base voids pass all the way through the platform base;

d. a plurality of base attachment mechanisms disposed between the top surface of the platform base and the bottom surface of the platform base respectively within the plurality of base voids; and e. a plurality of coupling mechanisms;

f. a plurality of human interface mechanisms; and g. a plurality of resistance bands each having a first end and a second end, wherein the first end of each of the plurality of resistance bands is respectively coupled with one of the plurality of base attachment mechanisms via one of the plurality of coupling mechanisms, and via a respective different one of the plurality of coupling mechanisms the second ends of the plurality of resistance bands are either collectively coupled with a first one of the plurality of human interface mechanisms or singularly and respectively coupled to different ones of the plurality of human interface mechanisms, further wherein each of the plurality of resistance bands can be stretched by applying pressure to the first one of the plurality of human interface mechanisms or the respective different ones of the plurality of human interface mechanisms, wherein each of the plurality of resistance bands may be wrapped around one or more of the plurality of base attachment mechanisms before or after each of the plurality of resistance bands is respectively coupled to the respective one of the plurality of base attachment mechanisms.

11. The portable strength training system of claim 10, wherein the first one of the plurality of human interface mechanisms is a workout bar and the different ones of the plurality of human interface mechanisms are selected from the group consisting of a hand grip, a wrist strap, an ankle strap, and a waist strap.

12. The portable strength training system of claim 10, wherein the platform base has a hinge, wherein the hinge allows the platform base to be folded.

13. The portable strength training apparatus of claim 10, wherein the platform base is made of a material selected from the group consisting of plastic and metal.

14. The portable strength training apparatus of claim 10, wherein the plurality of coupling mechanisms comprise clips or hooks.

15. The portable strength training apparatus of claim 10, wherein the handle is made of rope, plastic, or metal.

* * * * *